US005382197A

United States Patent [19]

Koury

[11] Patent Number: 5,382,197

[45] Date of Patent: Jan. 17, 1995

[54] VERTICAL BALL-LIFT WITH PNEUMATIC ACTUATOR

[76] Inventor: George D. Koury, 601 E. Nikolaus, Show Low, Ariz. 85901

[21] Appl. No.: 226,710

[22] Filed: Apr. 12, 1994

[51] Int. Cl.[6] ..... A63D 5/02

[52] U.S. Cl. ..... 473/111; 473/106

[58] Field of Search ..... 473/106, 110, 111, 54; 273/201, 179 R, 179 A, 179 D; 187/1 R, 29.2, 110, 9 E

[56] References Cited

U.S. PATENT DOCUMENTS

| | | | |
|---|---|---|---|
| 2,682,404 | 6/1954 | Lund | 473/111 |
| 2,682,406 | 6/1954 | Montooth | 473/111 |
| 3,237,943 | 3/1966 | Congelli | 473/111 |
| 4,509,752 | 4/1985 | Schmid | 273/49 |
| 4,640,511 | 2/1987 | Speranza | 273/49 |
| 4,658,934 | 4/1987 | Cooper et al. | 187/110 |
| 4,770,417 | 9/1988 | Blair | 273/49 |
| 5,076,582 | 12/1991 | Edwards | 273/49 |

FOREIGN PATENT DOCUMENTS

| | | | |
|---|---|---|---|
| 0653188 | 9/1964 | Belgium | 473/111 |
| 2595581 | 9/1987 | France | 473/111 |

*Primary Examiner*—William M. Pierce

[57] ABSTRACT

A mechanism for air assisted ball-lift that supplements current ball elevator mechanisms used to return bowling balls to the bowler. When the bowling ball is gravity fed onto the top pad, the trigger is depressed causing the mechanism to raise. The bowling ball is moved vertically by the use of an air cylinder in order to positively engage the ball elevator mechanism.

1 Claim, 12 Drawing Sheets

VERTICAL BALL-LIFT WITH PNEUMATIC ACTUATOR

BACKGROUND

1. Field of Invention

This invention relates to a bail-lift in an AMF 8270 and 8230 machine but not limited to an AMF bowling machine, specifically to an improved manner of returning bails for a bowling machine.

2. Description of Prior Art

AMF 8270 and 8230 bowling machines use kicker rollers to force the ball to elevate on a slanted flooring until it reaches the ball-lift assembly to return the ball. This system often causes ball damage from the kickers when any item delays the ball from getting into the ball-lift immediately, oil gets on rollers, or the rubber-/urathane is worn and exposes steel parts that can grind on the ball.

The AMF 8270 and 8230 ball return system has multiple moving parts and belts that often break and require many hours of maintenance.

The new AMF posi-lift does not damage the ball near as often, but is very expensive to change to if you are operating AMF 8270 and 8230 machines. This system also has many moving parts as well that require many hours of maintenance.

With all of the above mentioned ball-lifting systems, if failure occurs during a league the customers often are required to wait long periods of time while the system is being repaired.

OBJECTS AND ADVANTAGES

The vertical air ball-lift has shown, during a six month experimental period, no ball damage.

There are only four moving pans in the vertical air ball-lift, therefore, very little maintenance is required. Infact, during our six month experimental period, no maintenance has been required.

With only four moving parts, this vertical air ball-lift would be offered at a fraction of the cost of the posi-lift.

The design of the vertical air bail-lift allows the system to be changed in a two minute time period.

DRAWING FIGURES

In the drawings, closely related figures have the same number but different alphabetic suffixes.

Figure 1A:
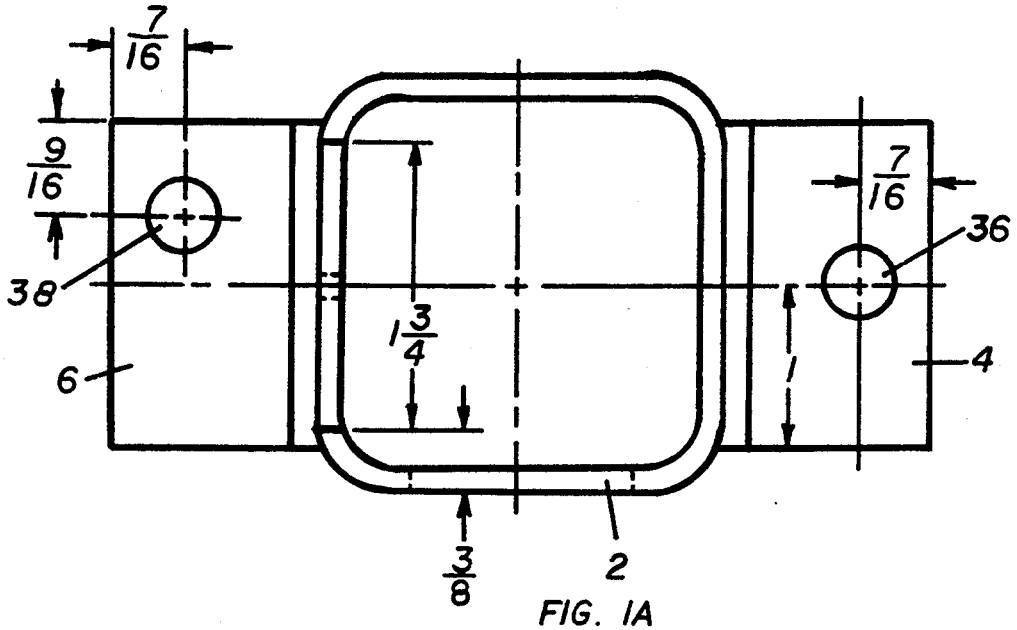
FIGS. 1A and 1B shows a top and side view of the outer base tube.

| Reference Numerals in Drawings | |
|---|---|
| 2 Outer Base Tube | 28 Air Cylinder |
| 4 Mounting Plate Back | 30 Top Plate Inside Slide |
| 6 Mounting Plate Front | 32 Airline Outlet |
| 8 Bottom Plate | 34 Air Cylinder Pin Hole |
| 10 Top Pad | 36 Mounting Plate Back Hole |
| 12F/B Rubber Pads | 38 Mounting Plate Front Hole |
| 14 Trigger | 40 Trigger Opening Hole |
| 16 Hinge | 42 Inside Slide Airline Outlet |
| 18 Trigger Weight | 44 Top Inside Slide Opening |
| 20 Air Cylinder Pin | 46 Air Cylinder Bolt Hole |
| 22 Switch Mount | 48 Switch Mount Hole |
| 24 Inside Slide | 50F/B Air Cylinder Pin Opening |
| 26 Switch | |

DESCRIPTION

Figure 1B:
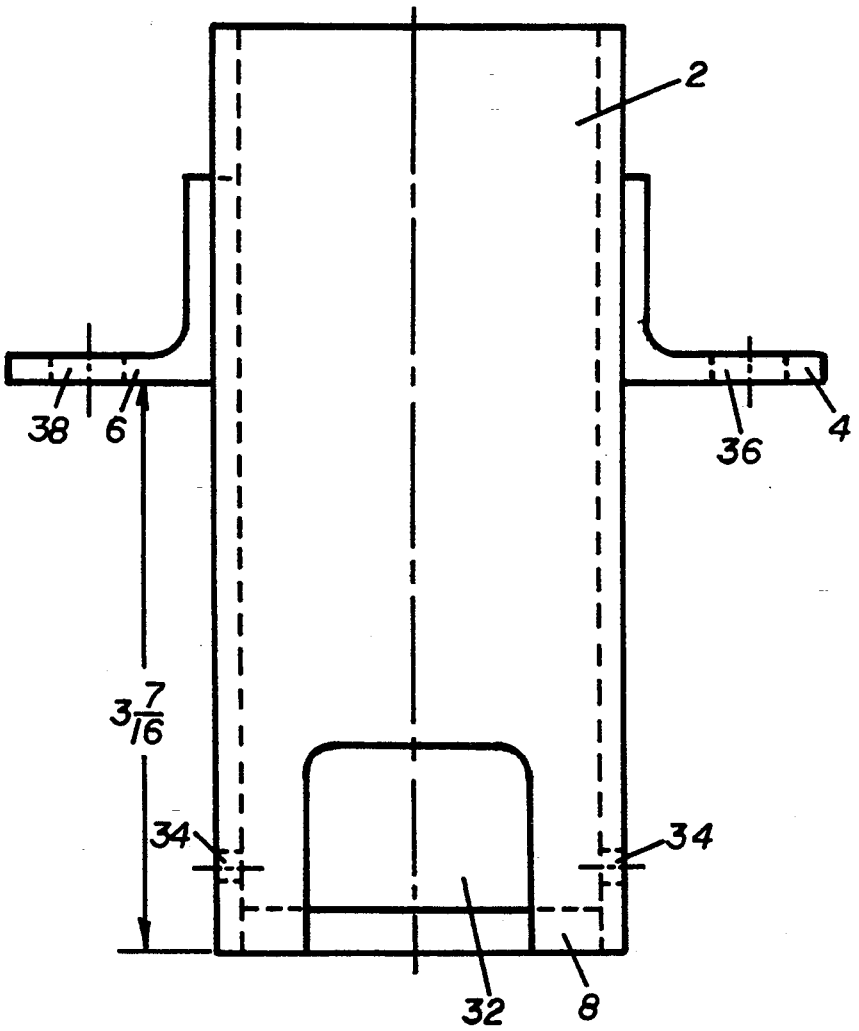
Figure 2A:
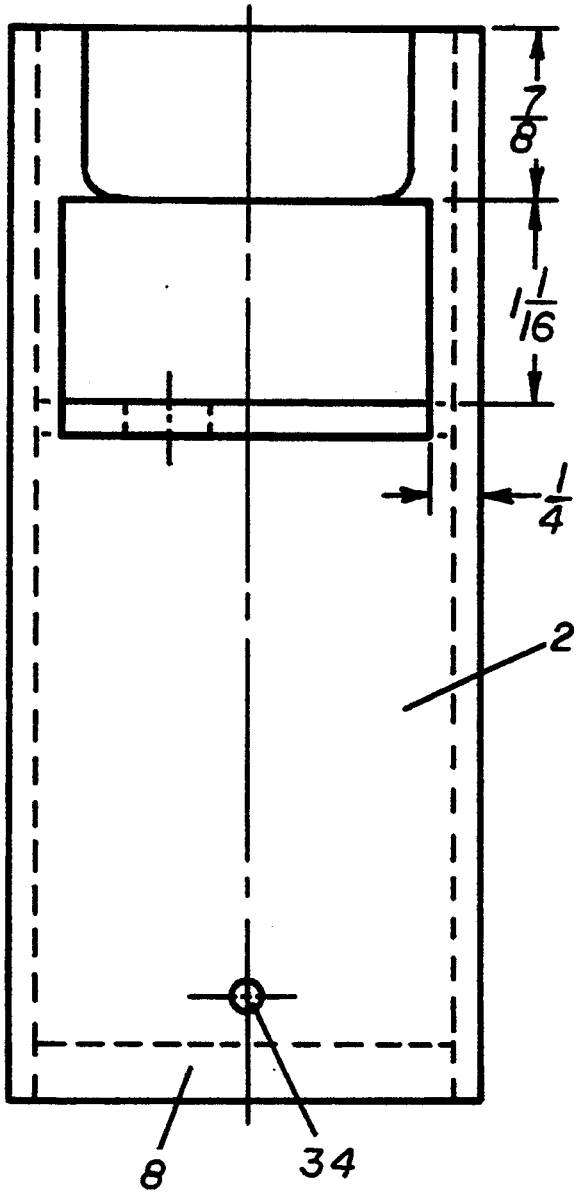
FIGS. 2A and 2B shows a front and back view of the outer base tube.
Figure 2B:
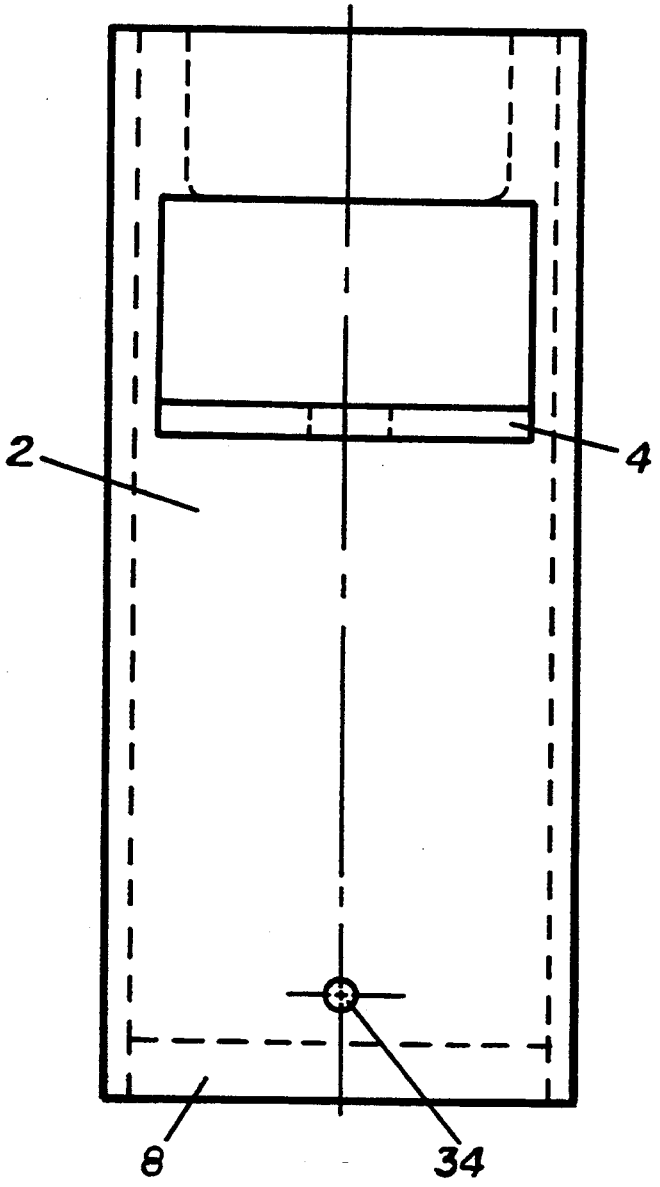

FIGS. 1A and 1B shows a perspective top and side view of the outer base tube The outer base tube 2 is 5⅝ long square 2½ steel tubing. Attach mounting plate back 4 and mounting plate front 6 which is 1¼ by 3/16" by 2" angle iron to outer base tube 2 exactly 3 7/16" to bottom of outer base tube 2. Cut airline outlet 32 at the bottom of outer base tube 2 centered 1¼ by 1⅜. Drill air cylinder pin hole 34 into outer base tube 2 which is opening for air cylinder pin 20. Weld ¼ steel bottom plate 8 cut to fit inside outer base tube 2 to be welded even with the bottom. Drill 7/16" mounting plate front hole 38 into mounting plate front 6 down 7/16" and in from front 9/16". Drill mounting plate back hole 36 into mounting plate back 4 centered 7/16" from back. The mounting plate holes 36/38 are offset to ensure proper installation. This completes the operating form of outer base tube 2 with all attached and completed openings.

Figure 3:
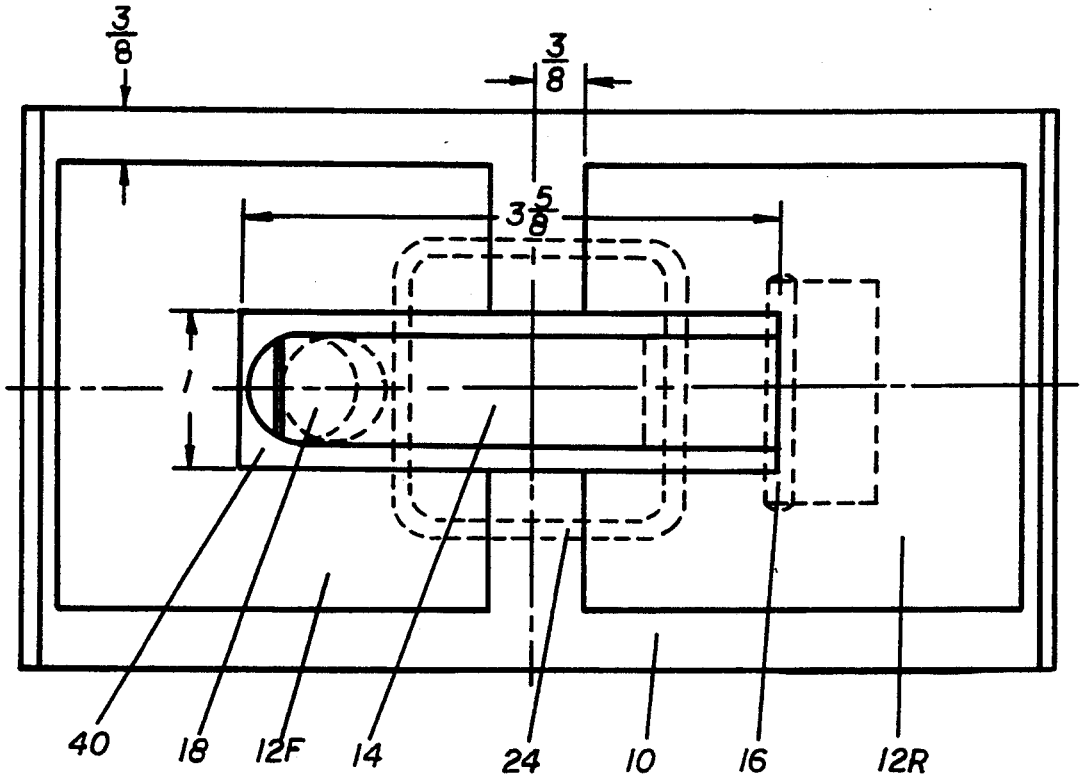
FIG. 3 shows a top view of the top pad.
Figure 4A:
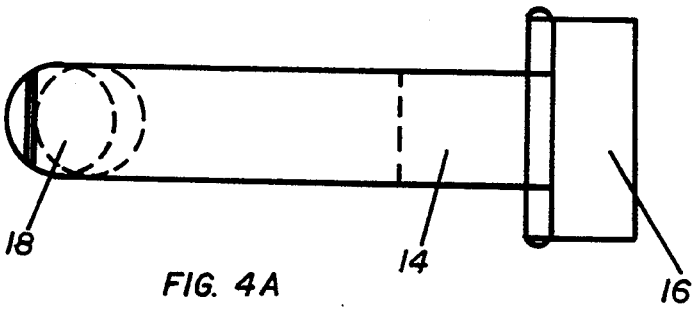
FIGS. 4A and 4B shows a top and side view of the trigger.
Figure 4B:
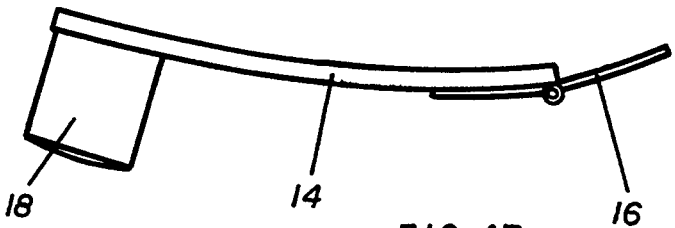
Figure 5:
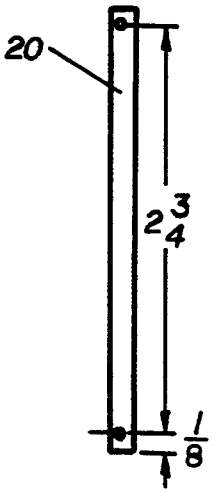
FIG. 5 shows the air cylinder pin.

FIG. 3 shows a top view of the top pad 10. Cut a 5" long 3¼ wide piece of steel from a round 12" well casing 3/16" thick to created the top pad 10. Cut 1" by 3⅝ hole centered to make trigger opening hole 40. Trigger 14 is 3/16" steel that is ¼ wide and 3½ long. Refer to FIGS. 4A and 4B taking trigger 14 weld ¼ cold roll steel ¼ long to make trigger weight 18 which will create a half circle in front. Grind off excess steel of trigger 14 to match shape of trigger weight 18. Purchase small hinge at any local hardware store, cut down one side of hinge to ¼ long and width of trigger 14 to make hinge 16. Weld hinge 16 to bottom of trigger 14. Center trigger assembly, FIG. 4B, into trigger opening hole 40 welding available side of hinge 16 to bottom of top pad 10. This completes the top pad 10 with all attached parts to perform task during operation which we will refer to as top pad 10 assembly.

Figure 6:
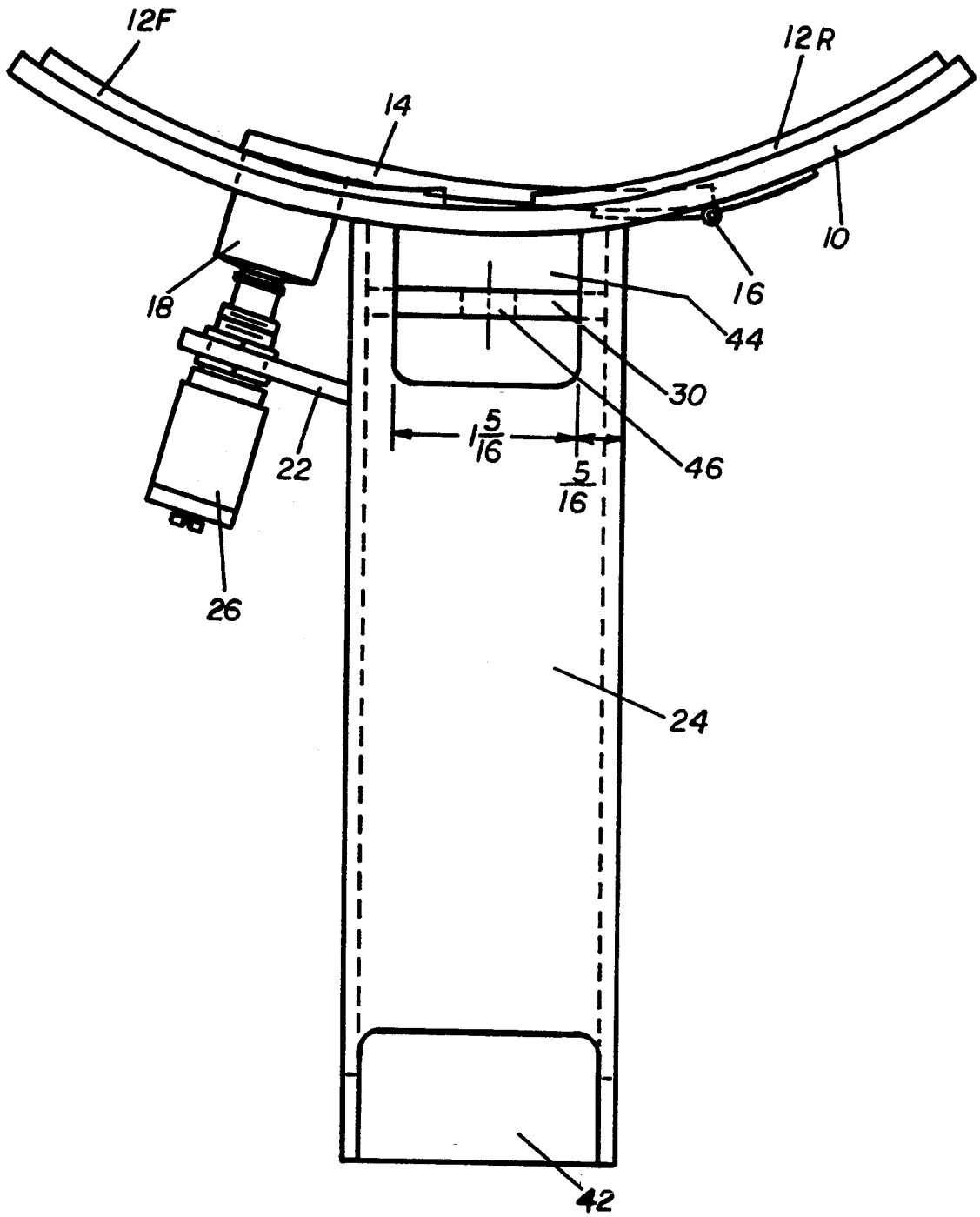
FIG. 6 shows the top pad and inner slide with switch attached.

FIG. 6 shows the inside slide 24 with top pad 10 assembly attached. Inside slide 24 is made from 2" square steel tubing being 6¾ long. Cut top inside slide opening 44 from side to side 1⅛ down. On same side of inside slide 24, cut inside slide airline outlet 42 which is 1¼ high by 1⅜ wide opening centered in tubing. Cut plate inside slide 30 from 3/16" fiat steel to fit inside slide 24. Drill ⅜ hole centered on top plate inside slide 30. Weld top plate inside slide 30 to inside slide 24 down ½ from top, which will actually be centered in top inside slide opening 44. Weld inside slide 24 to top pad 10 centering the inside slide 24 with top inside slide opening 44 and inside slide airline outlet 42 on left side with top inside slide opening 44 on the top.

Figure 7A:
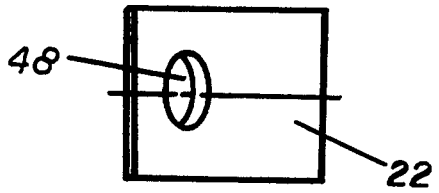
FIG. 7A and 7B shows the switch mount.
Figure 7B:
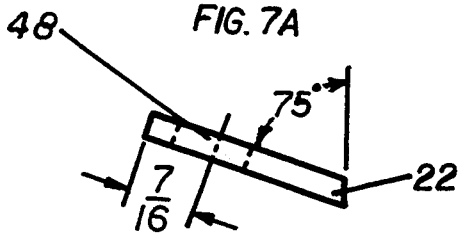

FIG. 7 shows the switch mount. Make the switch mount 22 from 1" by 1 5/16" flat steel ⅛ thick. Drill 7/16" hole 7/16" from front centered in switch mount 22 to make switch mount hole 48. On front of inside slide 24 centered 1 5/16" down from top pad 10 weld switch mount 22 at a 75 degree angle tilted up. The switch is Omrion Model 6X288 with plunger type action.

Figure 8B:
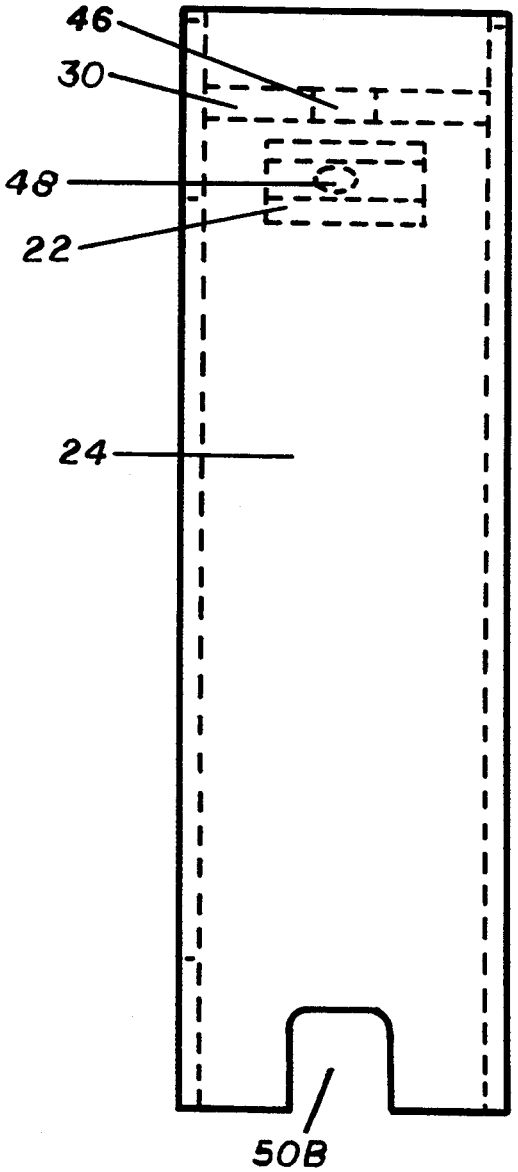
FIGS. 8A and 8B shows the front and back view of the inner slide.
Figure 8A:
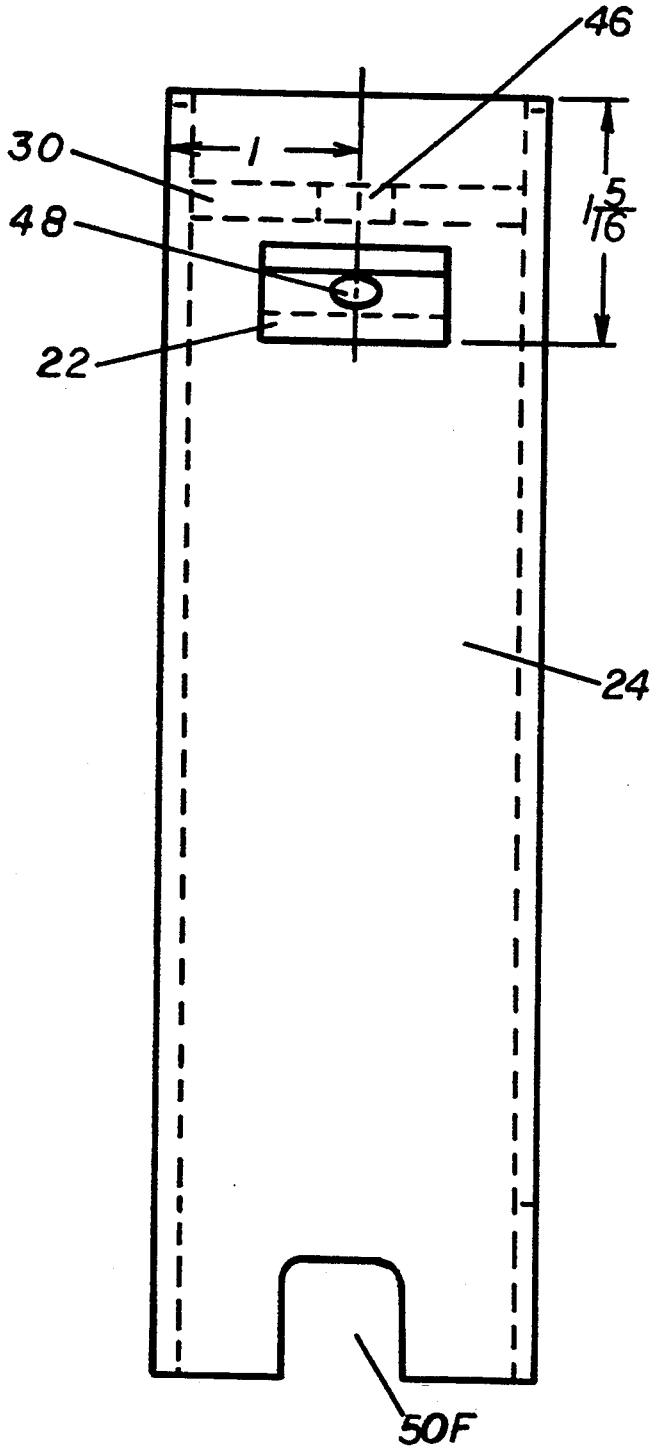

FIG. 8 shows inside slide 24 with air cylinder pin openings 50F/B. On inside slide 24 cut on front and back an opening 11/16" from each side a hole 5/8" wide and 7/16" high to make air cylinder pin openings 50F/B.

Figure 9C:
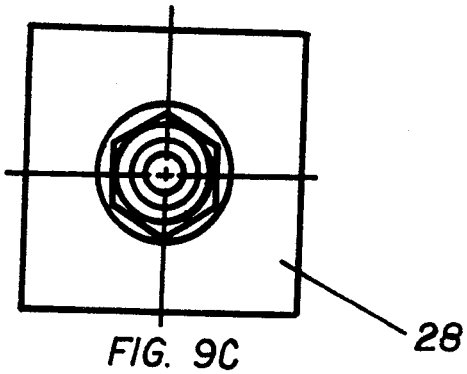
FIGS. 9A, 9B and 9C shows the Speedaire Cylinder-Model 1A431.
Figure 9A:
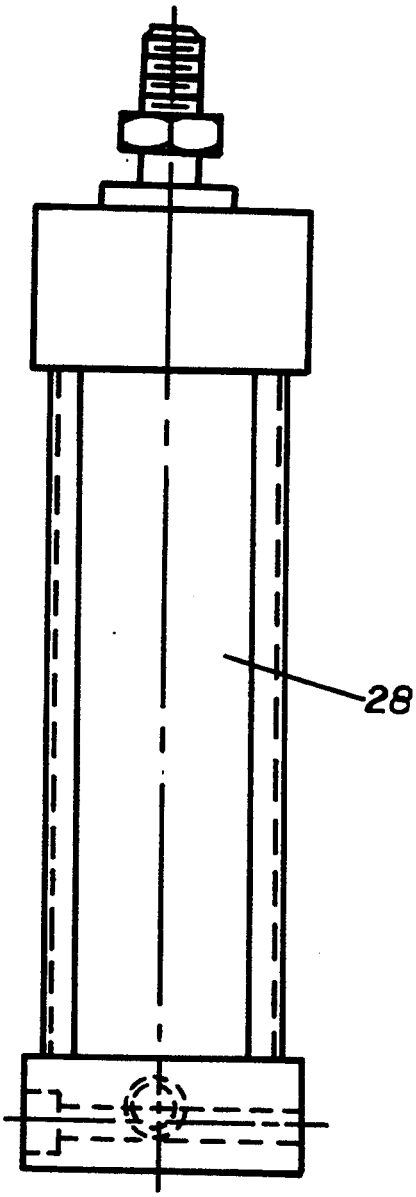
Figure 9B:
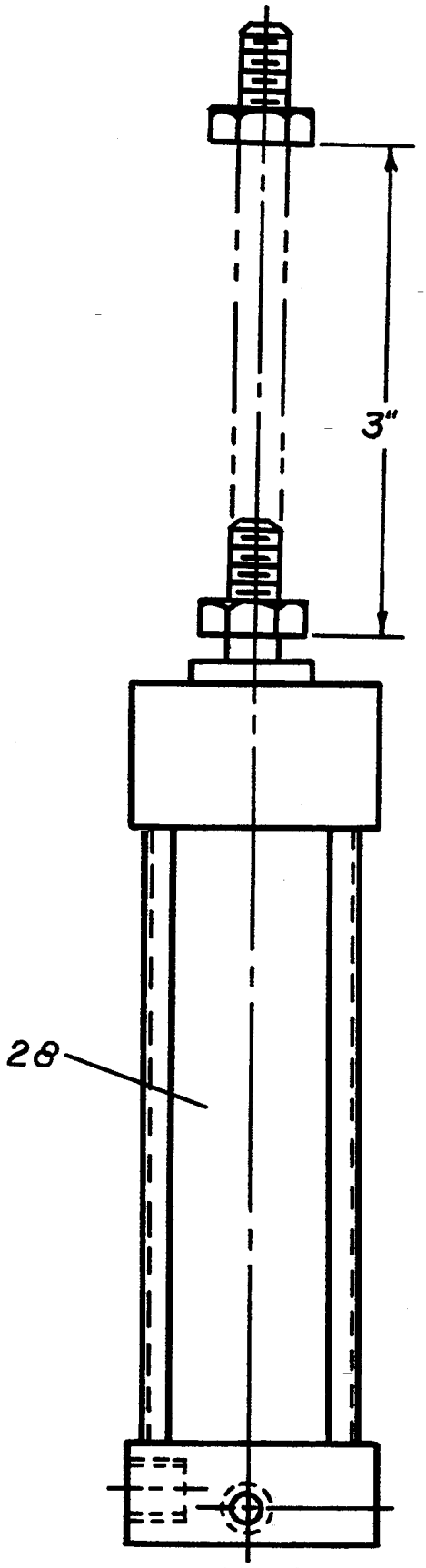

FIG. 9A and 9B shows air cylinder 28. Air cylinder 28 is a speedaire cylinder model 1A431.

Figure 10:
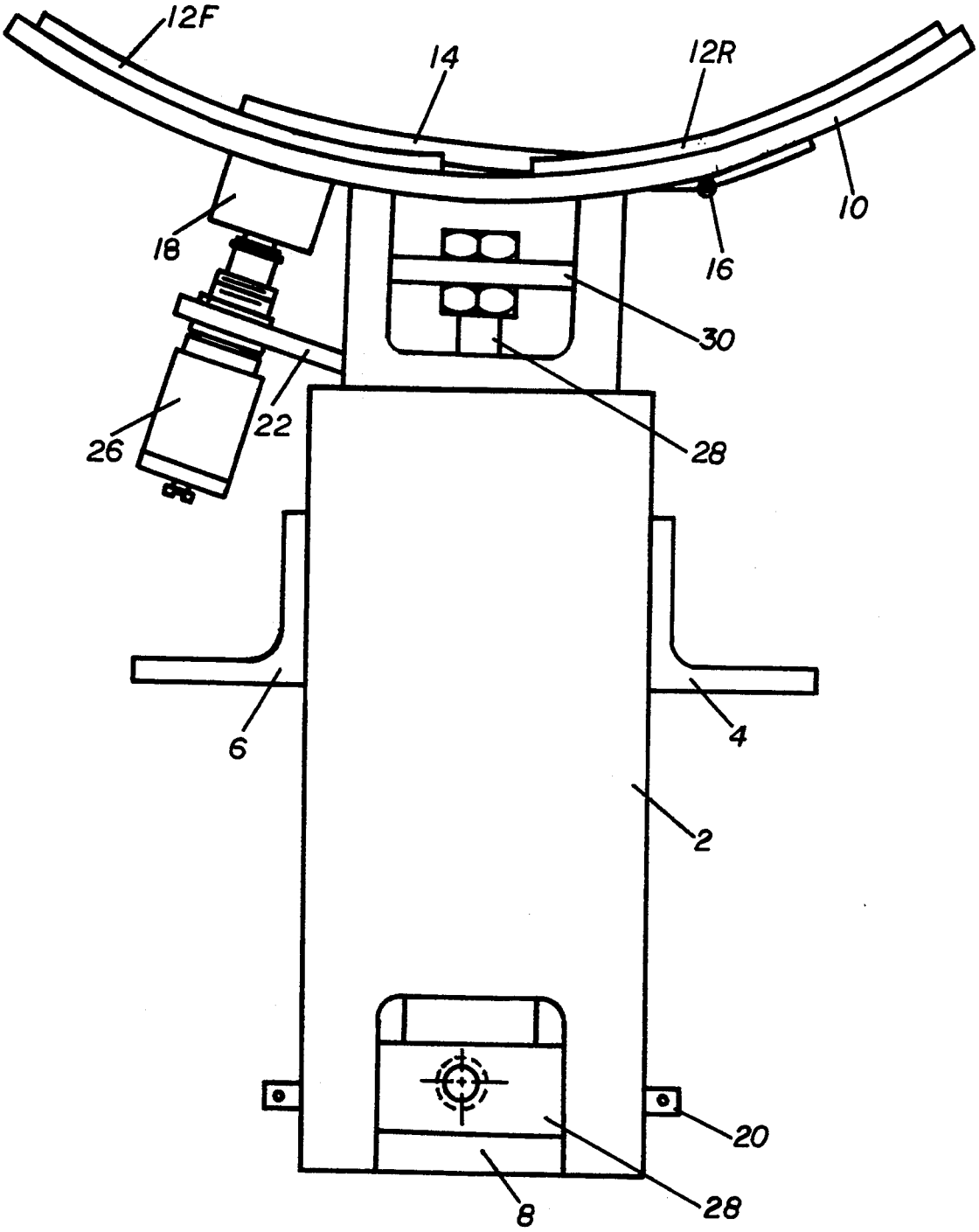
FIG. 10 shows the entire vertical air ball-lift in the down position.

FIG. 10 shows the top pad 10 assembly attached to the inside slide 24 which is in place inside the outer base tube 2 with air cylinder 28 and switch 26 attached in lowered position. This is a drawing of the vertical air ball-lift as it would appear waiting for the unharmed bowling ball to gravitate onto the trigger.

Figure 11:
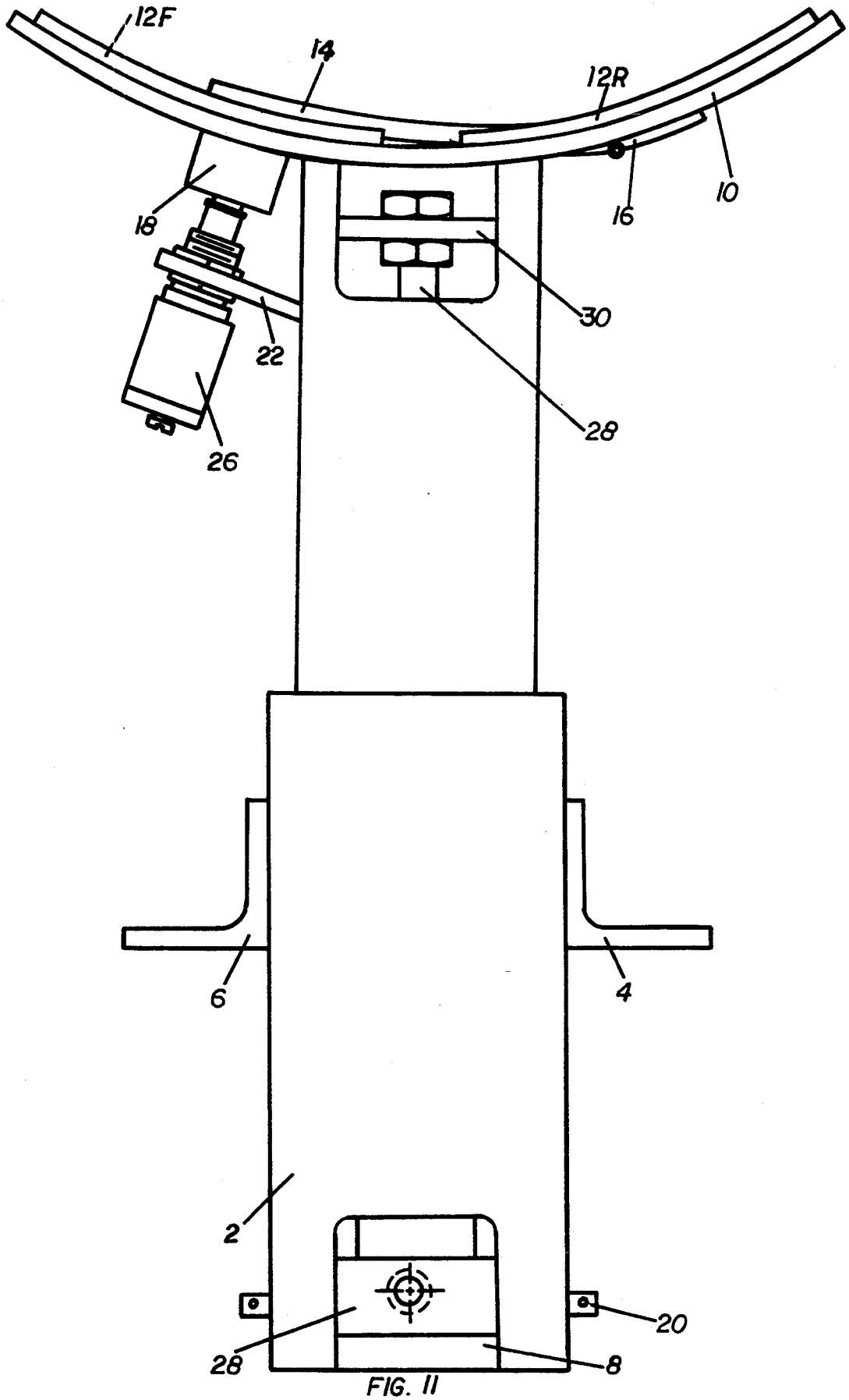
FIG. 11 shows the entire vertical air ball-lift in the elevated position.

FIG. 11 shows the same attachments as FIG. 10, but the vertical air ball-lift is in an elevated position having just raised the bowling ball to the ball-lift assembly.

Figure 12:
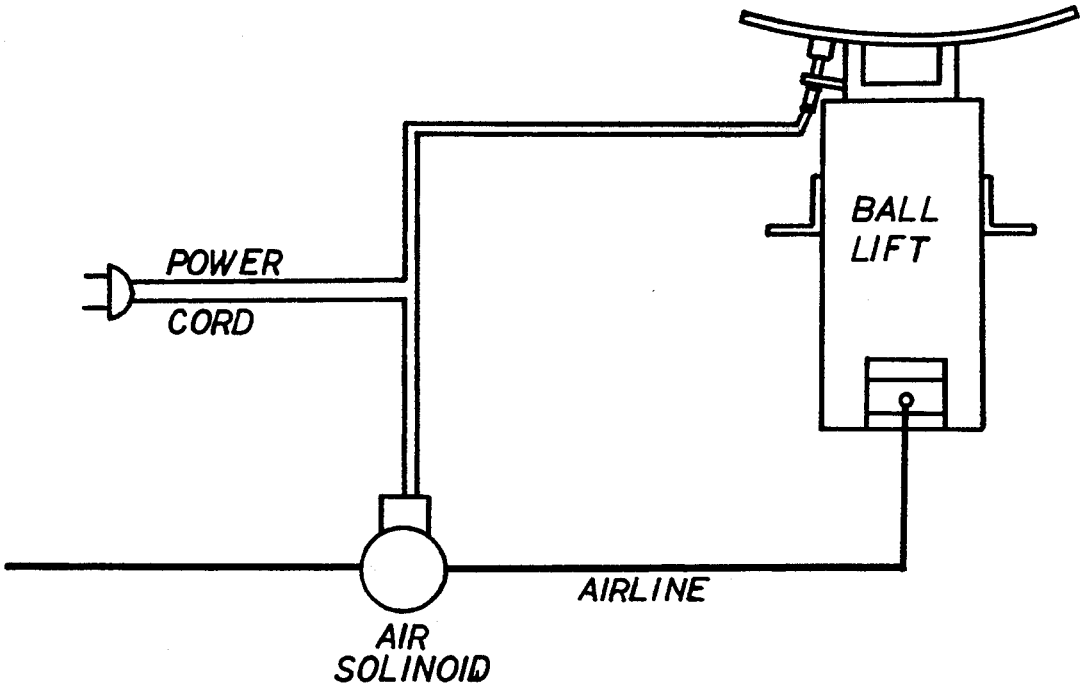
FIG. 12 shows power and air supply diagram.

FIG. 12 is a diagram of the power supply to the vertical air ball-lift for clarity since it is powered separately from the bowling machine.

OPERATION

There are a few modifications necessary to install and operate the vertical air balllift in AMF bowling machines models 8270 and 8230. First, remove the entire kicker roller assembly, all filler pads, and starter pad assembly. After removing these parts, using two pieces of 1¼ angle iron bolt these pieces to the bottom of the frame under the ball-lift area. These two pieces allow you an area to bolt the vertical air ball-lift using mounting plate back/front holes 36/38. Center the vertical air bail-lift under the ball-lift assembly.

Using existing AMF 8270 posi-lift opening sides will allow a natural method using gravity to get the ball to center on top pad 10.

When the bowling ball enters the machine, it will be gravity fed to the ball door opening. The ball will automatically center itself over the top of the vertical air ball-lift which will depress trigger 14. After trigger 14 is depressed this action will activate switch 26. The air solenoid from Schrader Bellows model 74313-0115 will then open allowing air to be fed into air cylinder 28. Once air cylinder 28 has been charged with air, the ball will be vertically lifted into the ball-lift assembly. As soon as ball is lifted off of trigger 14, switch 26 will then break the circuit to the air solenoid which allows inside slide 24 assembly to come back to a neutral position.

This system is independent from bowling machines receiving power and air from outside sources.

CONCLUSION

The simplicity of the design makes the vertical air ball-lift almost maintenance free for extended periods of time (results shown from six month study). If failure, entire system can be changed within a two minute period. The simplicity of the design of the vertical air ball-lift would also allow this equipment to be manufactured at a cost that a small business owner could afford to upgrade.

I claim:

1. An air assisted ball-lift attached to and in combination with an automatic pinsetter comprising;

a. an outer tubular housing slidably containing an inner tubular housing within an interior thereof, the combination which facilitates the raising and lowering of said inner tubular housing;

b. a top pad means attached to an end of the inner tube for supporting a ball;

c. a trigger assembly means which is mounted within said inner tubular housing and to the top pad for sensing the presence of a ball and for initiation of operation of an electrical switch;

d. an electrical switch connected to said trigger assembly means for activating an accessory solenoid;

e. an accessory air solenoid connected to said electrical switch; and f. an air cylinder mounted to the base of the outer tubular housing and mounted to an uppermost end of the inner tubular housing, being connected to said air solenoid which activates said air cylinder for producing linear energy to the inner tubular housing so as to cause a vertical movement of the top pad in order to raise a bowling ball.

* * * * *